United States Patent [19]

Maxwell et al.

[11] 4,207,982

[45] Jun. 17, 1980

[54] FLIP TOP CONTAINER

[75] Inventors: Donald J. Maxwell; David J. Crisp, both of London, England

[73] Assignee: Sterling Drug Inc., New York, N.Y.

[21] Appl. No.: 35,902

[22] Filed: May 3, 1979

[30] Foreign Application Priority Data

May 30, 1978 [GB] United Kingdom ..... 24382/78

[51] Int. Cl.[2] ..... B65D 45/00; B65D 83/04; B65D 85/56

[52] U.S. Cl. ..... 206/534; 215/230; 206/459; 220/230; 220/252

[58] Field of Search ..... 206/534, 540, 538, 459; 215/230, 203; 220/252, 282, 213

[56] References Cited

U.S. PATENT DOCUMENTS

| | | | |
|---|---|---|---|
| 2,185,284 | 1/1940 | Wilson | 220/252 |
| 3,151,599 | 10/1964 | Livingston | 215/230 |
| 3,355,067 | 11/1967 | Espinal | 206/534 |
| 4,011,829 | 3/1977 | Wachsmann et al. | 206/534 |

*Primary Examiner*—William T. Dixson, Jr.
*Attorney, Agent, or Firm*—Wenderoth, Lind & Ponack

[57] ABSTRACT

This invention relates to a pivotal closure for a container. The closure structure includes a collar defining an opening, and associated with the opening is a lid mounted for rotation about an axis generally coaxial with this opening. This lid is further mounted for pivoting about an axis normal to the axis of rotation between a closed position in which the lid closes the opening and an open position in which an aperture defined by the lid and/or the collar allows access through the opening. The rotation of the lid is governed by a cam mechanism operable by pivoting movement of the lid. The can mechanism is, generally, a saw-tooth cam surface associated with either the collar or the lid and a cam follower associated with either the collar or the lid, so that pivoting the lid from a closed position through an open position and back to a closed position causes the lid to rotate about the axis of the opening by an amount determined by the cam surface.

24 Claims, 4 Drawing Figures

FLIP TOP CONTAINER

BACKGROUND OF THE INVENTION

This invention relates to the packaging of pharmaceutical compositions, and particularly concerns the packaging of drugs to encourage patient compliance, that is, to encourage patients to take drugs in the proper dosages and at the times prescribed by their doctors.

Conventionally, when a doctor prescribes medication for a patient, the prescription is taken to a pharmacy where the appropriate quantities of the prescribed drugs are placed in one or more containers on which the doctor's directions for administration are placed. All too frequently, however, the container is simply marked "Take as directed" or "Take as before", leaving it up to the patient to remember the correct details.

It is essential, if the prescribed treatment is to be fully effective, for the patient to comply with the specific instructions for administration concerning the medication. This is obviously easier when the instructions are clearly written on the container, but even with specific instructions non-compliance with the instructions frequently occurs, and ultimately, the patient either deliberately or, more usually, inadvertently fails to take the appropriate dosage at the appropriate time. Clearly the patient who tends to be forgetful is most prone to non-compliance, but taking the required medication at the right time is also a serious problem for the geriatric patient who often has the added problem of having to take several different drugs at different frequencies and in different quantities. In addition, it has also been found that non-compliance is a problem with younger patients and, particularly, busy executives who simply forget to take their drugs at the correct times.

If the prescribed treatment is not followed, then not only is it not fully effective, but more seriously it is possible that non-compliance may in some circumstances lead to dangerous side effects.

SUMMARY OF THE INVENTION

The present invention is concerned with providing a new form of closure for containers which are used to dispense drugs and which provides a reminder of when the next administration is due. This closure is primarily intended for use in conjunction with containers for solid pharmaceutical preparations, particularly tablets or pills, and is described hereinafter in relation to these containers. It is, however, equally possible to use the present invention on containers intended for a wide variety of other applications, as will be apparent to one skilled in the packaging art.

In one aspect, therefore, this invention provides a closure for a container. The closure structure includes a collar defining an opening and associated with the opening is a lid mounted for rotation about an axis generally coaxial with this opening. This lid is further mounted for pivoting about an axis normal to the axis of rotation between a closed position in which the lid closes the opening and an open position in which an aperture defined by the lid and/or the collar allows access through the opening. The rotation of the lid is governed by a cam mechanism operable by pivoting movement of the lid. The cam mechanism is, generally, a saw-tooth cam surface associated with either the collar at the lid and a cam follower associated with either the collar or the lid, so that pivoting the lid from a closed position through an open position and back to a closed position causes the lid to rotate about the axis of the opening by an amount determined by the cam surface.

The closure of the invention may be used to encourage patient compliance by applying it to the mouth of a container for prescribed drugs. Each time the closure is operated by first moving the lid to the open position, to extract a dose through the opening and the aperture, and then returning the lid to the closed position, the lid is rotated relative to the collar so that the rotational position of the lid relative to the collar is a function of the number of times the closure is operated. By providing either the lid or the collar with a scale showing the sequence of times prescribed for administration of the contents of the container and the other, either the lid or the collar, with a datum mark, the different rotational positions of the lid are distinguished and the position of the datum mark relative to the scale indicates when the next dose is due. The closure thus provides a visual indication of whether treatment is being followed, as well as a reminder of when the next dosage in the prescribed treatment is due.

BRIEF DESCRIPTION OF THE DRAWINGS

Further objects and better understanding of the present invention will be apparent from the following description in conjunction with the accompanying drawings in which.

DETAILED DESCRIPTION OF THE INVENTION

Figure 1:
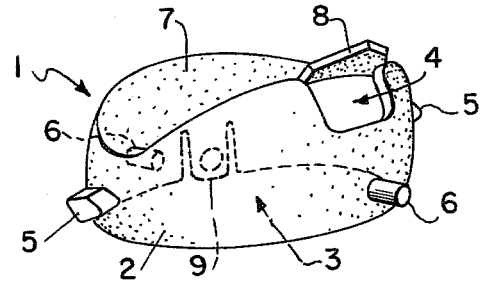
FIG. 1 is a schematic perspective view of a lid for use in a closure of the invention.

The lid 1 in FIG. 1 generally comprises a partially spherical shell 2 with a downwardly-projecting mouth 3. The shell 2 is provided with an aperture 4 through which the contents of a dispenser incorporating the lid 1 may be dispensed.

The shell 2 is provided with two pegs 5 of generally elliptical cross-section on diametrically opposite sides of the shell 2, and the lid 1 may pivot about these pegs 5. The shell 2 is also provided with a pair of pins 6 projecting from opposite portions of the shell 2; these pins 6 act as cam followers in the completed closure of the invention.

The upper portion of the lid 1 is formed with a pair of angled contiguous surfaces 7 adapted to receive manual pressure to pivot the lid 1 about the pegs 5. The surfaces 7 are arranged with one surface generally above each of the pins 6, and with the common edge of the surfaces parallel to an axis defined by the two pegs 5. A pointer 8 projects from the shell adjacent the aperture 4.

The lid 1 is also provided with a resiliently deformable tongue 9 in the spherically-curved wall of the shell 2 diametrically opposite the aperture 4. This tongue 9 is defined by two slits in the wall of the shell and is provided with any integrally-formed protrusion in the form of an outward bulge at or near its free end.

Figure 2:
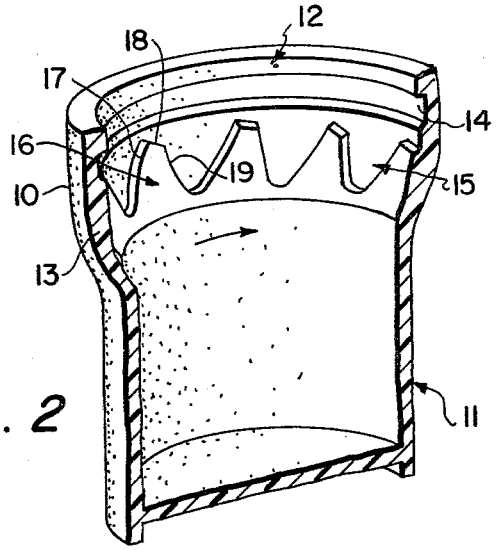
FIG. 2 is a cross-sectional view of a container incorporating a collar for use in conjunction with the lid of FIG. 1 to form a closure of the invention.

The lid 1 is intended to be mounted within a collar 10 of a container 11 shown in FIG. 2. The collar 10 extends from and surrounds the mouth of the cylindrical container 11, thereby defining an opening 12 in the container. The collar 10 has a cylindrically curved wall 13, with a circular groove 14 of rectangular cross-section around the inside surface thereof. Below the groove 14, on the inside surface of the wall 13 is an endless saw-tooth ledge or cam surface 15 made up of twelve substantially identical teeth 16 which have an inclined leading surface 17, a relieved tip 18 and a trailing surface 19. This ledge 15 forms a cam surface in the closure of the assembled dispenser.

The opening 12 into the container 11, before assembly of the dispenser, may be sealed by a sealing membrane (not shown) which is advantageously formed with the container 11 of a plastics material.

Figure 3:
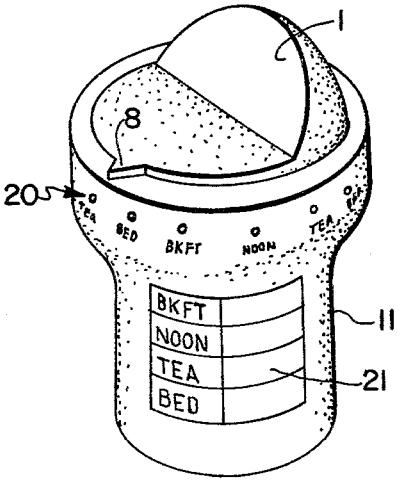
FIG. 3 is a perspective view of a dispenser of the invention formed by mounting the lid of FIG. 1 into the container of FIG. 2 of the lid of the closure being in the closed position.
Figure 4:
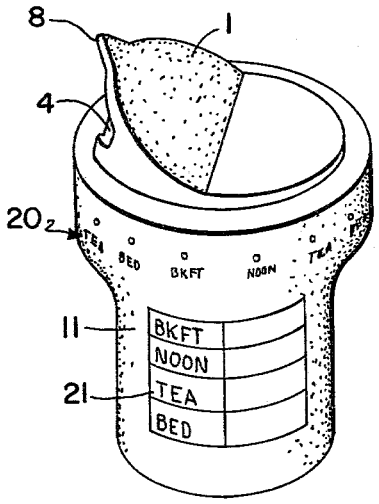
FIG. 4 is a perspective view of the dispenser of FIG. 3 with the lid in the open position.

The lid 1 shown in FIG. 1 is mounted in the collar 10 by inserting the pegs 5 into the groove 14, so that pins or cam followers 6 lie on or adjacent the cam surface 15. The lid is then able to rotate about the cylindrical axis of the container 11 and pivot about the axis defined by the pegs 5. The rotation and pivoting are governed by the cam mechanism formed by the pins 6 riding on the cam surface 15. The effect of this cam mechanism is such that: operating the closure by pivoting the lid 1 between a closed position (in which the aperture 4 is masked by the collar 10 as shown in FIG. 3) and an open position (in which aperture 4 is raised clear of the collar as shown in FIG. 4) and pivoting the lid 1 back to a closed position causes the lid 1 to rotate through 30° , the angular rotation corresponding to one tooth 16, in the direction shown by the arrow in FIG. 2. To achieve this control, the angular separation of pins 6 corresponds to five and a half teeth, so that the pins 6 contact complementary portions of the cam surface Thus, when the lid is in the closed position the pin 6 below the aperture 4 contacts a "valley" between two teeth 16 and the second pin 6 contacts or lies adjacent the relieved portion 18 of the tooth 165° around the collar. By pressing the appropriate surface 7 of the lid to rock the lid 1 to the open position, the second pin 6 is forced down a relieved portion 18 and a trailing edge 19 into a valley, and the first pin 6 is likewise forced up a leading edge 17 to lie at or adjacent a relieved portion 18. By so doing, the pins are forced to move through a 15° displacement with a corresponding displacement of the lid. Similarly, the closing of the lid 1, by rocking it to the closed position, causes an additional 15° angular displacement resulting in the total of 30° rotation of the lid relative to the collar during opening and closing.

As shown in FIGS. 3 and 4, the outer surface of the collar 10 is marked at 30° intervals with the time of administration, so that following each dispensing operation (opening and closing) of the dispenser, the pointer 8 indicates on a scale 20 the time when the next dosage is to be administered.

In the closed position, the bulge of the tongue 9 engages the groove 14 of the collar 10 and imparts a positive positioning to the lid in that position. Manual pressure on the surface 7 remote from the aperture 4 disengages the tongue 9 from groove 14 and enables the lid to pivot to the open position as defined above.

Since it may be necessary to administer more than one item from the dispenser at any one time, the outer surface of the dispenser is also adapted to receive information relating to the nature of each dosage. Thus, in FIGS. 3 and 4, the dispenser is provided with a label 21 onto which the directions for each dosage may be applied by the pharmacist preparing a prescription.

The closure of this invention may be a separate unit adapted to be attached to the container 11 when needed. In that case the collar 10 is provided with means for attaching it to a suitable container. For example, the collar 10 may be provided with a screw-threaded portion co-operable with a complementary threaded portion on the container 11 so that it may be screwed onto the container. For the purpose of encouraging patient compliance, however, it is desirable that the closure of the invention be attached in such a way that it cannot readily be removed, and most preferably, this is achieved as shown by forming the collar 10 integrally with the container 11.

In one preferred aspect of the invention, where, as shown, the lid 1 is mounted within the collar 10 for pivoting about a diameter of the circular cross-section of the lid, the pegs 5 project from the circumference of the lid 1 on opposite diametric ends thereof. It should be noted, however, that even though it has been found particularly convenient to mount the lid 1 in this way, it is also possible according to the invention for the mounting to be effected by providing two pegs which project instead from the collar to locate within a circular groove in the lid. In either of these arrangements, the pegs are preferably substantially circular, part-circular or elliptical in cross-section, since such shapes enable the lid to pivot smoothly thereabout. The groove itself is chosen to have a cross-section compatible with the profile of the pegs. In the preferred embodiment of the invention the pegs have a nearly rectangular profile and the groove has a corresponding rectangular cross-section.

The pivotal freedom of the lid 1 must be sufficient to enable it to rock between the open and closed positions. The amount of movement required to perform this operation varies with the particular shape and dimensions of the lid and collar. It will, however, generally be significantly less than half a revolution about the pivotal axis, and usually less than a right angle. Preferably, the angle through which the lid pivots between the open and closed positions is in the range of from 15° to 75° , but usually in the range of from 30° to 60° , and most preferably in the range of from 30° to 40°.

In its closed position, the lid 1 generally completely closes the opening 12. By this, it is meant that the opening 12 is blocked sufficiently to prevent the contents of a container 11 from passing therethrough. If the device is intended for use with particularly large articles, it may not be necessary for the opening 12 to be entirely covered or blocked by the closed lid, but for most applications it is preferable that the opening 12 be substantially completely covered in the closed position. This is particularly desirable when the lid 1 is used on a pharmaceutical container, since the contents of the container will not be visible through the closed closure, which reduces the tendency for children to try to extricate the contents.

In its open position, the lid 1 and/or the collar 10 have the aperture 4 through which access is gained through the opening 12 into the container 11. In the preferred arrangement, the aperture 4 is provided in the lid 1, the aperture 4 being positioned so that it is obscured by the collar 10 in the closed position, but is clear of the collar 10 in the open position. As shown in the Figures, the lid 1 is mounted within the circular opening 12 defined by the collar 10 and has an aperture 4 provided in the lid 1 remote from the ends of the pivotal axis of the pegs 5 so that maximum displacement of the aperture 4 is obtained when the lid is pivoted between the closed and open positions. In a second arrangement which is also possible according to the invention, though not shown, the aperture 4 may be formed in the collar 10 so that it is obscured by the closed lid, but so that it is open when the lid 1 is raised in the open position. However, since the lid rotates when opened and closed, for this arrangement to be effective it is necessary to provide a series of apertures around the collar corresponding to the rotational positions of the lid. While this arrangement may be desirable for some applications, it is generally not preferred. In a third embodiment, which is somewhat a variation of the preferred embodiment, the aperture is defined simply as a space between the open lid and the collar—that is to say, when the lid is moved into the open position the space between the lid and the collar provides an aperture allowing access through the opening 12 and into an associated container.

The lid 1 is preferably generally disc-shaped or part-spherical, and this shape is particularly suited to the arrangement employing the aperture 4 in the lid. As indicated above, the lid most preferably is in the form of a part-spherical shell 2 having the aperture 4 formed in the spherically-curved shell wall. The shell 2 is mounted with its mouth directed towards a container associated with the closure. The portion of the shell remote from the mouth (the portion directed away from an associated container) is preferably adapted to facilitate manual manipulation of the lid between its closed and open position and this is preferably achieved by providing the recessed portion in the otherwise convexly curved wall remote from the mouth, the recessed portion being formed for receiving manual pressure to move the lid between its closed and open positions and between its open and closed positions. In the preferred embodiment, the recessed portion is defined by the two generally planar wall surfaces 7 on either side of the pivotal axis of the lid which are most preferably a pair of inclined planes contiguous along a common edge substantially parallel to the pivotal axis.

The movement of the lid is governed by the cam mechanism so that pivoting the lid between open and closed necessarily causes it to rotate always in the same direction. This is achieved by the saw-tooth ledge 15. In the preferred embodiment of FIG. 2, the cam surface or ledge 15 and cam follower 6 are positioned on the collar and the lid, respectively. Of course, it is recognized that the opposite disposition of the components may be employed.

The cam surface 15 and cam follower or pins 6 are arranged so that the pivoting of the lid 1 tends to move the cam follower 6 transversely with respect to the saw-tooth cam surface 15, while the shape of the teeth 16 allows this transverse movement only by forcing the cam follower 6 to move longitudinally with respect to the cam surface 15, thereby forcing the lid 1 to rotate relative to the collar. Operating the lid to thereby move it from the closed position to the open position and back to the closed position drives the cam follower 6 up the leading edge 17 of a tooth, across the relieved portion 18 and down the trailing edge 19 of the tooth into the valley between that tooth and the next tooth in the cam surface, thereby causing the cam follower to move longitudinally of the cam surface by the width of one tooth.

It is usually desirable for the cam surface 15 to have the regular saw-tooth shape as shown—that is, with all the teeth of substantially identical shape. In some applications, however, it may be desirable for the closure to be operable only a limited number of times, in which case the cam surface may be provided with an appropriate number of teeth and an abutment to prevent further movement of the lid relative to the collar after the desired number of operations. But it is more commonly desirable for the closure to be operable without any limitation on the number of operations imposed by the cam mechanism, and to achieve this, the cam surface is formed as the endless saw-tooth track.

Obviously, the width of the teeth in the cam surface determines the amount by which the lid 1 rotates during the opening and closing operation. Also, the height of the teeth may be used to limit the degree of pivotal freedom of the lid. The selection of appropriate values for these parameters is within the competence of the man skilled in the art, given the particular circumstances of a specific closure of the invention. By selecting the dimensions of the saw-tooth cam surface appropriately, it is a simple matter to obtain the desired degree of pivotal and rotational movement of the lid. If the cam surface 15 is in the form of a saw-tooth slot (not shown) a single peg 6 may be sufficient to act as the cam follower since its movement is easily constrained in the desired manner. However, for ease of manufacture it is desirable that the cam surface be formed as the saw-tooth abutment surface or ledge 15 as shown, and the cam follower must then be urged into contact with this ledge to ensure that the proper combined pivotal/rotational movement is obtained. The cam follower may be urged into contact with the surface by biasing means, such as a spring, acting between the collar and the lid. It is an especially preferred feature of this invention, however, to achieve effective operation without needing to resort to the use of separate biasing means, by employing a cam follower comprising two pegs 6 spaced so as to engage the surface at complementary portions of the saw-tooth separated by at least one tooth. By "complementary portions" is meant portions of the saw-tooth which are half a tooth out of phase with each other, so that when one peg 6 is located at the tip of a tooth the other peg lies in the valley between two teeth at a different point of the saw-tooth. In this way at least one peg is always maintained in contact with the cam surface to produce the desired rotation. Both pegs will not necessarily be in contact with the cam surface at the same time because the necessary control will be achieved by the one peg if the other leaves the cam surface. In particular, the cam mechanism may be arranged so that in normal operation one peg is displaced beyond the tip of the teeth of the cam surface at each extremity of the pivotal movement, provided that when the pivotal movement is then reversed the rotational movement in a single sense is sustained.

For an endless saw-tooth cam surface 15 having n teeth, the two pegs 6 may be spaced at $360/n\ (x+\frac{1}{2})^\circ$ around the track, where x is an integer between 1 and $n-2$. For ease of operation it is desirable for the pegs to be separated by the maximum possible amount; thus when n is odd, the angular separation is preferably 180°, and when n is even, the angular separation is preferably $180\ (1\pm 1/n)^\circ$.

The value of n, and thus the number of teeth, determines the amount of which the lid rotates with each cycle of opening and closing. The lid rotates 360° /n relative to the collar in opening the closed lid and reclosing it. If the closure of the invention is to be used to relate to times of administration of pharmaceutical preparations there are preferably enough teeth in the cam surface to ensure that each possible time of administration has a unique relative position of the collar and lid, while ensuring that the rotation of 360° /n allows sufficient space on the closure for that unique position to be identified. It has been found convenient for n to be an integer of from 6 to 24, and preferably from 8 to 16.

Studies were conducted to establish means of identifying unambiguously common administration times for pharmaceutical preparations in a manner which is independent of regional variations in language. It is usual to identify administration times to mealtimes, but this can lead to difficulties—for example, in some areas the midday meal is called lunch and in others dinner, similarly the evening means is variously called supper and dinner. For a regimen requiring 4 doses per day it has been discovered a preferred description of these doses is:

Breakfast
Noon
Teatime
Bedtime where 3 doses per day are needed one of these times can be omitted, most conveniently the Teatime or Bedtime dose.

The closure of the invention is primarily intended for use in dispensing pharmaceutical preparations administered 3 or 4 times per day, and thus it is particularly preferred that n is 12.

The use of the closure of the invention to promote drug compliance requires that the various relative positions of the collar and lid be identified, and thus as indicated hereinbefore either the collar or the lid is preferably provided with the scale 20 and the other is provided with a pointer or other datum mark 8. However, it may be desirable to provide a pharmacist with an unmarked closure so that an appropriate scale can be applied to the closure when needed to suit a particular patient. In this case, the collar and lid should be suitably adapted to receive such information. It is generally most convenient if, as shown, the lid incorporates the pointer, preferably at or near the aperture, with the collar either being adapted to receive a scale of administration times or having a suitable scale applied thereto. When a scale is applied to the collar, it should be effected in such a way that the position of the pointer on the scale may be readily ascertained by visual inspection.

The operation of the closure of the invention is assisted if a positive location of the lid is provided when in the closed position, since this prevents the lid from inadvertently falling into the open position, while providing a means of making the container more childproof—since the degree of effort required to open the lid by moving it out of the closed position may be selected to be beyond the capabilities of a young child. This positive location in the closed position is achieved by a biased protrusion 9 on either the lid or the collar portion which, when the lid is closed fits into a corresponding detent on the other member. It is normally preferred, as shown in FIG. 1, for the protrusion 9 to be on the lid 1, with the corresponding detent formed in the collar.

Obviously the force required to dislodge the protrusion 9 from the detent should not be so great as to hinder or prevent those intended to operate the closure, but merely be sufficient to provide resistance against accidental or unwanted displacement. The location may, for example, be provided by means of a spring ball (forming the protrusion) resting in a cup (the detent), but more simply may be provided by the resiliently-deformable tongue 9 having an integrally formed protrusion on the lid biased into the groove provided in the collar for mounting the lid as described hereinbefore.

The closure of this invention may be formed from a wide variety of materials with regard, of course, to their compatibility with the likely contents of a container with which they will be associated, and indeed the materials of that container. It is preferred that the closure be formed of a natural or synthetic plastics material such as polyethylene, polypropylene, polystyrene, a polyester, a polycarbonate, PVC, nylon, acrylonitrile butadiene styrene (ABS), an acetal resin, or a multipolymer. Particularly preferred of the plastic materials are high density polyethylene or polypropylene. The closure may be formed of one of these materials or different portions thereof may be formed of different materials. Other materials may be used, however, and it is believed to be within the competence of one skilled in the art to select an appropriate material for a particular set of circumstances.

This invention extends to a dispenser comprising a container having a closure of the invention attached around an opening to the container. As indicated hereinbefore, the collar 10 is preferably formed integrally with the container 11 and the combined container and collar are preferably formed of a plastics material. This collared container may then be assembled into a dispenser by mounting a suitable lid 1 within the collar portion of the container. By forming the lid of plastics material of sufficient flexibility it would be possible to "snap" the lid into position in the collar.

It is envisaged that a collared container may be supplied to a pharmacist filled with the appropriate drugs and sealed by a strippable sealing membrane formed from a metal foil. When required to dispense a prescription, the pharmacist selects a collared container holding the prescribed drug, removes the sealing membrane, and mounts a suitably dimensioned lid within the integral collar of the container. The pharmacist then applies a scale of time of administration to the dispenser, if this was not already marked on the closure, and finally provides the dispenser with any necessary information relating to the dosage, such as the number of tablets to be administered at each relevant time. The dispenser is preferably adapted to receive this information relating to dosage, which may conveniently be in the form of the pre-printed label 21 to which hand-written dosage instructions may be applied.

The patient using the dispenser merely opens it by rocking the lid 1 to the open position when the next dose indicated by pointer 8 is due. The number of tablets, capsules or the like are extracted as indicated on the label 21. The lid is then closed by rocking it back to the closed position. The time of the next dose due is then indicated by the pointer 8.

Even though the present invention has been described by way of the preferred embodiment and several variations, it is still recognized that further embodiments may be developed which are within the teaching of this invention; therefore, it is not intended that the present invention be strictly limited to the embodiments disclosed herein.

What is claimed is:

1. A closure for a container having an access opening thereinto, said closure comprising:

a collar surrounding said opening into said container;

a lid member rotatably mounted within said collar for rotation about an axis of rotation coaxial with the axial center of said collar, said lid member further being pivotable between open and closed positions about a pivotal axis normal to said axis of rotation, said lid member having an aperture therethrough which is accessible when said lid member is pivoted in the open position, whereby access into said container through said aperture is possible;

camming means between said lid member and said collar for controlling the pivoting and rotational movement of said lid member within said collar, said camming means being comprised of:

a saw-tooth cam surface around the inside surface of said collar;

a cam follower on said lid member movable along said cam surface, whereby pivoting said lid member causes said cam follower on said lid member to move across said cam surface, thereby rotating said lid member about said axis of rotation.

2. A closure for a container having an access opening thereinto, said closure comprising:

a collar surrounding said opening into said container;

a lid member rotatably mounted within said collar for rotation about an axis of rotation coaxial with the axial center of said collar, said lid member further being pivotable between open and closed positions about a pivotal axis normal to said axis of rotation, said lid member having an aperture therethrough which is accessible when said lid member is pivoted in the open position, whereby access into said container through said aperture is possible;

camming means between said lid member and said collar for controlling the pivoting and rotational movement of said lid member within said collar, said camming means being comprised of:

a saw-tooth cam surface around the outer surface of said lid member;

a cam follower on the inside of said collar, whereby pivoting said lid member causes said cam surface to move along said cam follower, thereby rotating said lid member about said axis of rotation.

3. A closure as claimed in claim 1 or 2 wherein said collar is integrally formed with said container.

4. A closure as claimed in claim 1 or 2, wherein:

said opening into said container and said collar are circular; and said lid member has a circular cross-section.

5. A closure as claimed in claim 4, wherein said lid member is partially spherical shaped.

6. A closure as claimed in claim 4, wherein said lid member is generally disc-shaped.

7. A closure as claimed in claim 1, wherein:

said collar has a circular groove around the inside surface thereof; and said lid member has a pair of pegs projecting therefrom into said circular groove.

8. A closure as claimed in claim 7, wherein said pegs project from said lid member on diametrically opposite sides thereof.

9. A closure as claimed in claim 1 or 2, wherein said lid member pivots from 15° to 75° about said pivotal axis.

10. A closure as claimed in claim 1 or 2, wherein said lid member pivots from 30° to 40° about said pivotal axis.

11. A closure as claimed in claim 1 or 2, wherein said aperture in said lid member is positioned therethrough remote from the ends of said pivotal axis, whereby maximum displacement of said aperture is achieved when said lid member is pivoted about said pivotal axis.

12. A closure as claimed in claim 11, wherein:

said lid has a partially spherical shape; and said aperture is formed through the spherically shaped sidewall of said lid member.

13. A closure as claimed in claim 12, wherein said lid member has a recess in the outer surface thereof, the lowest part of said recess being substantially parallel to said pivotal axis.

14. A closure as claimed in claim 13, wherein said recess has two generally planar wall sections intersecting substantially at said pivotal axis.

15. A closure as claimed in claim 1, wherein said cam surface is an endless saw-tooth track.

16. A closure as claimed in claim 15, wherein said cam follower is a pair of pins angularly spaced from each other by at least the distance between one saw-tooth of said cam surface, said pins being adapted to engage said saw-tooth track at complementary positions therealong.

17. A closure as claimed in claim 16, wherein:

said endless saw-tooth cam surface has n teeth; and the angular separation between said pegs is 180° when n is an odd integer and is $180(1\pm1/n)°$ when n is an even integer.

18. A closure as claimed in claim 17, wherein n is an integer from 8 to 16.

19. A closure as claimed in claim 18, wherein n is 12.

20. A closure as claimed in claim 1 or 2, wherein:

said lid member has a pointer thereon; and said collar has a scale thereon.

21. A closure as claimed in claim 1 or 2, wherein:

said lid member has a protrusion biased away from it;

said collar member has a detent therein for receiving said biased protrusion when said lid member is in the closed position; and said biased protrusion is displaceable from said detent when said lid member is pivoted into the open position.

22. A closure as claimed in claim 21, wherein said biased protrusion is a resiliently-formed tongue member on said lid member, said tongue member having an integrally formed protrusion extending therefrom and engageable with said detent.

23. A closure as claimed in claim 21, wherein said detent is a groove around the inside of said collar.

24. A closure as claimed in claim 1 or 2, wherein means is provided on said container for providing instructions thereon.

* * * * *

UNITED STATES PATENT AND TRADEMARK OFFICE

CERTIFICATE OF CORRECTION

PATENT NO. : 4,207,982

DATED : June 17, 1980

INVENTOR(S) : DONALD J. MAXWELL ET AL.

It is certified that error appears in the above-identified patent and that said Letters Patent are hereby corrected as shown below:

On the title page, in the Abstract, line 11, change "can" to --cam--.

Column 3, line 36, after "surface" insert --15.--.

Column 6, line 68, change "of" to --by--.

Signed and Sealed this

*Twenty-third* Day of *November 1982*

[SEAL]

*Attest:*

GERALD J. MOSSINGHOFF

*Attesting Officer*

*Commissioner of Patents and Trademarks*